US005332711A

United States Patent [19]

Takiguchi et al.

[11] Patent Number: 5,332,711

[45] Date of Patent: Jul. 26, 1994

[54] THERMAL TRANSFER IMAGE-RECEIVING SHEET

[75] Inventors: Ryohei Takiguchi; Hitoshi Saito; Masanori Torii; Jun Hasegawa, all of Tokyo; Tetsuo Shiraiwa, Osaka; Eriko Hayashi, Kyoto; Michiyuki Kono, Kyoto; Shigeo Mori, Kyoto, all of Japan

[73] Assignees: Dai Nippon Printing Co., Ltd.; Dai-Ichi Kogyo Seiyaku Co., Ltd., Japan

[21] Appl. No.: 996,200

[22] Filed: Dec. 22, 1992

[30] Foreign Application Priority Data

Dec. 27, 1991 [JP] Japan ..... 3-358240

[51] Int. Cl.[5] ..... B41M 5/035; B41M 5/38

[52] U.S. Cl. ..... 503/227; 428/195; 428/423.1; 428/913; 428/914

[58] Field of Search ..... 8/471; 428/195, 913, 428/914, 423.1; 503/227

[56] References Cited

U.S. PATENT DOCUMENTS 4,421,826 12/1983 Ohlson et al. ..... 428/394

OTHER PUBLICATIONS

Database WPIL, No. 86-200667, Derwent Publications Ltd; London, GB; JP-A-61132367 (Dai Nippon Pringing) Jun. 19, 1986.

*Primary Examiner*—B. Hamilton Hess

*Attorney, Agent, or Firm*—Parkhurst, Wendel & Rossi

[57] ABSTRACT

The present invention provides a thermal transfer image-receiving sheet which can form a clear image having a sufficiently high density and excellent in various types of fastness, particularly durability such as light fastness, fingerprint resistance and which is plasticizer resistance according to a thermal transfer printing process wherein use is made of a heat migratable dye. The thermal transfer image-receiving sheet includes a substrate sheet and a dye-receiving layer formed on at least one surface of the substrate sheet, wherein the dye-receiving layer includes a product of a reaction of a polyoxyalkylene polyol with an organic polyisocyanate.

5 Claims, No Drawings

THERMAL TRANSFER IMAGE-RECEIVING SHEET

BACKGROUND OF THE INVENTION

The present invention relates to a thermal transfer image-receiving sheet. More particularly, the present invention is concerned with a thermal transfer image-receiving sheet capable of forming a record image excellent in coloring density, sharpness and various types of fastness, particularly durability such as light fastness, fingerprint resistance and plasticizer resistance.

Various thermal transfer printing processes are known in the art. One of them is a transfer printing process which comprises supporting a sublimable dye as a recording agent on a substrate sheet, such as a polyester film, to form a thermal transfer sheet and forming various full color images on an image-receiving sheet dyeable with a sublimable dye, for example, an image-receiving sheet comprising paper, a plastic film or the like and, formed thereon, a dye-receiving layer.

In this case, a thermal head of a printer is used as heating means, and a number of color dots of three or four colors are transferred to the image-receiving material by heating for a very short period of time, thereby reproducing a full color image of an original by means of the multicolor dots.

Since the color material used is a dye, the image thus formed is very clear and highly transparent, so that the resultant image is excellent in reproducibility and gradation of intermediate colors, and according to this method, the quality of the image is the same as that of an image formed by conventional offset printing and gravure printing, and it is possible to form an image having a high quality comparable to a full color photographic image.

Not only the construction of the thermal transfer sheet but also the construction of an image-receiving sheet for forming an image are important for usefully practicing the above-described thermal transfer process.

For example, Japanese Patent Laid-Open Publication Nos. 169370/1982, 207250/1982 and 25793/1985 disclose prior art techniques applicable to the above-described thermal transfer image-receiving sheet, wherein the dye-receiving layer is formed by using a polyester resin, vinyl resins such as a polyvinyl chloride, a polycarbonate resin, a polyvinyl butyral resin, an acrylic resin, a cellulose resin, an olefin resin and a polystyrene resin.

In the above-described thermal transfer image-receiving sheet, it is known that the dyeability of the dye-receiving layer and various types of durability and storage stability of an image formed thereon greatly vary depending upon the kind of the resin constituting the dye-receiving layer.

The dyeing capability of the dye which is transferred can be improved by improving the diffusivity of the dye at the time of the thermal transfer through the formation of the dye-receiving layer from a resin having a good dyeability or the incorporation of a plasticizer in the dye-receiving layer. In the dye-receiving layer comprising the above-described resin having a good dyeability, the formed image blurs during storage. Therefore, the storage stability is poor or the fixability of the dye is poor, so that the dye bleeds out on the surface of the image-receiving sheet, which causes other articles in contact with the surface of the sheet to be liable to staining.

The above-described problems of storage stability and staining can be solved by selecting such a resin that the dye transferred to the dye-receiving layer is less liable to migration within the dye-receiving layer. In this case, however, the dyeing property of the dye is so poor that it is impossible to form an image having a high density and a high sharpness.

There are other large problems such as the light fastness of transferred dye, fading of the formed image due to sweat or sebum migrated to the image surface when a hand touches the image portion, swelling or cracking of the image-receiving layer per se, fingerprint resistance, migration of the dye when the dye contacts with a substance containing a plasticizer, such as an eraser or a soft vinyl chloride resin, that is, plasticizer resistance.

Three-dimensional crosslinking of the resin layer for receiving a dye is considered as means for solving the above-described problems, and several proposals have been made on the three-dimensional crosslinking. Examples thereof include a method disclosed in Japanese Patent Laid-Open Nos. 215398/1983, 199997/1986, 34392/1990, 178089/1990 and 86494/1990 wherein the three-dimensional crosslinking is conducted by reacting a polyester resin with a polyisocyanate and a method disclosed in Japanese Patent Laid-Open Nos. 160681/1989, 123794/1989 and 126587/1991 wherein the three-dimensional crosslinking is conducted by reacting a vinyl chloride/vinyl acetate copolymer having active hydrogen with a polyisocyanate.

In these methods, however, the amount of an active hydrogen having an isocyanate group, which can be introduced into one molecule, is limited. For example, in the case of a polyester resin, although the proportion of the hydroxyl group can be increased by reducing the molecular weight, the proportion of the hydroxyl group is necessarily low when the polyester resin has a commonly used molecular weight (a number average molecular weight of 10,000 or more). Further, in the case of a vinyl chloride/vinyl chloride acetate copolymer resin, although a hydroxyl group can be introduced by saponifying vinyl acetate monomer units, an increase in the proportion of the hydroxyl group (40% by mole or more) causes the copolymer to become insoluble in a general purpose solvent other than an alcohol. Therefore, the amount of introduction of the hydroxyl group should be reduced, which causes the crosslinking density of the dye-receiving layer to be low.

DISCLOSURE OF THE INVENTION

Accordingly, an object of the present invention is to provide a thermal transfer image-receiving sheet which can provide a clear image having a sufficiently high density and which is excellent in various types of fastness, particularly durability such as light fastness, fingerprint resistance and plasticizer resistance according to a thermal transfer printing process wherein use is made of a heat migratable dye such as a sublimable dye.

The above-described object can be attained by the following present invention. That is, the present invention provides a thermal transfer image-receiving sheet comprising a substrate sheet and a dye-receiving layer formed on at least one surface of the substrate sheet, wherein said dye-receiving layer comprises a product of a reaction of a polyoxyalkylene polyol with an organic polyisocyanate.

When a product of a reaction of a polyoxyalkylene polyol with an organic polyisocyanate is used as a resin component for forming a dye-receiving layer, it becomes possible to provide a thermal transfer image-receiving sheet which can provide a clear image having a sufficiently high density and which is excellent in various types of fastness, particularly durability such as light fastness, fingerprint resistance and plasticizer resistance.

DETAILED DESCRIPTION OF THE INVENTION

The present invention will now be described in more detail with reference to the following preferred embodiments of the present invention.

The thermal transfer image-receiving sheet of the present invention comprises a substrate sheet and a dye-receiving layer formed on at least one surface of the substrate sheet.

There is no particular limitation on the substrate sheet used in the present invention, and examples of the substrate sheet useable in the present invention include synthetic paper (polyolefin, polystyrene and other synthetic paper), wood free paper, art paper, coat paper, cast coat paper, wall paper, paper for backing, paper impregnated with a synthetic resin or an emulsion, paper impregnated with a synthetic rubber latex, paper containing an internally added synthetic resin, fiber board, etc., cellulose fiber paper, and films or sheets of various plastics such as polyolefin, polyvinyl chloride, polyethylene terephthalate, polystyrene, polymethacrylate and polycarbonate. Further, use may be made of a white opaque film or a foamed sheet prepared by adding a white pigment or filler to the above described synthetic resin and forming a film from the mixture or foaming the mixture.

Further, use may be made of a laminate comprising any combination of the above-described substrate sheets. Typical examples of the laminate include a laminate comprising a combination of a cellulose fiber paper with a synthetic paper and a laminate comprising a combination of a cellulose fiber paper with a plastic film or sheet. The thickness of these substrate sheets may be arbitrary and is generally in the range of from 10 to 300 μm.

When the substrate sheet is poor in the adhesion to a receiving layer formed on the surface thereof, it is preferred that the surface of the substrate sheet be subjected to a primer treatment or a corona discharge treatment.

The receiving layer formed on the surface of the substrate sheet serves to receive a sublimable dye moved from the thermal transfer sheet and to maintain the formed image.

The polyoxyalkylene polyol used in the present invention can be prepared, for example, by addition-polymerizing an alkylene oxide with an active hydrogen compound in the presence of a catalyst and removing the catalyst by a generally known purification method such as an ion-exchange method, a neutralization filtration method or an adsorption method and has a number average molecular weight of 200 to 10,000, preferably 200 to 5,000.

Examples of the active hydrogen compound include compounds having two or more active hydrogen groups, for example, polyhydric alcohols such as ethylene glycol, propylene glycol, 1,4-butanediol, glycerin, trimethylolpropane, pentaerythritol, dipentaerythritol, sorbitol, sucrose and tris-(2-hydroxyethyl) isocyanurate, amine compounds such as monoethanolamine, ethylenediamine, diethylenetriamine, 2-ethylhexylamine and hexamethylenediamine and phenolic active hydrogen compounds such as bisphenol A, hydroquinone and its hydrogenation product.

Examples of the alkylene oxide include ethylene oxide, propylene oxide and buthylene oxide.

When these alkylene oxide is addition-polymerized with the above described active hydrogen compounds, the polymerization may be any of a homopolymerization and a copolymerization and the addition may be conducted in any order. Although a basic catalyst, such as sodium methylate, sodium hydroxide or lithium carbonate, is generally used as the catalyst for addition polymerization, it is also useful to use a Lewis acid catalyst, such as boron trifluoride, and an amine catalyst, such as trimethylamine or triethylamine. In this case, the amount of use of the catalyst may be substantially the same as that generally adopted in the art.

In the present invention, particularly preferred examples of the polyoxyalkylene polyol include compounds represented by the following structural formulae A to E.

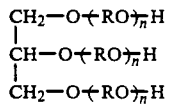
(A)

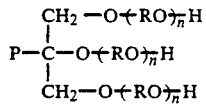
(B)

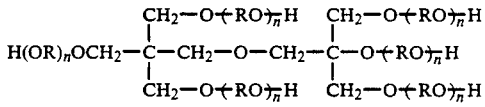
(C)

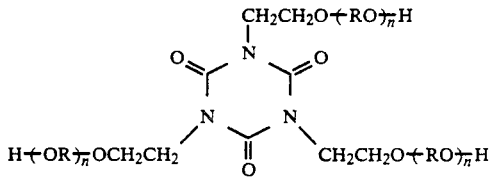
(D)

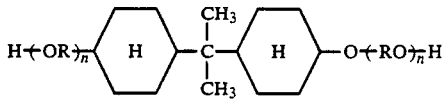
(E)

wherein R stands for $-C_2H_4-$,

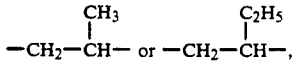

P stands for $CH_2CH_3$ or $CH_2O-(-RO-)_n-H$ and n is a numeric value capable of providing a number average molecular weight of 200 to 5,000.

Examples of the organic polyisocyanate used in the crosslinking of the above-described polyol include 2,4-tolylene diisocyanate (2,4-TDI), 2,6-tolylene diisocyanate (2,6-TDI), 4,4'-diphenylmethane diisocyanate (MDI), hexamethylene diisocyanate (HMDI), isophorone diisocyanate (IPDI), triphenylmethane tridiisocyanate, tris(isocyanatephenyl) thiophosphate, lysine ester triisocyanate, 1,8-diisocyanato-4-isocyanate methyloctane, 1,6,11-undecane triisocyanate, 1,3,6-hexamethylene triisocyanate, bicycloheptane triisocyanate and further compounds called "isocyanate adduct" such as biuret-bonded HMDI, isocyanurate--bonded HMDI and adduct of 3 moles of trimethylolpropane TDI and mixtures thereof.

When the above described polyoxyalkylene polyol and organic polyisocyanate are reacted with each other, it is preferred to react them in such a proportion that the number of organic polyisocyanate groups is 0.8 to 2.5 times the number of hydroxyl groups located at the terminal of the polyoxyalkylene polyol.

When the reaction is completed in an early stage, the use of a catalyst is advantageous. Examples of the catalyst include organic metal catalysts such as dibutyl tin dilaurate (DBTDL), dibutyl tin diacetate (DBTA), phenyl mercury propionate and lead octenoate and amine catalysts such as triethyelendiamine, N,N'-dimethylpiperadine, N-methylmorpholine, tetramethylguanidine and triethylamine.

In the present invention, the above-described polyurethane resins may be used alone or in the form of a mixture of two or more of them. Further, it is also possible to use them in combination with other thermoplastic resins, for example, polyolefin resins such as polypropylene, halogenated polymers such as polyvinyl chloride and polyvinylidene chloride, vinyl polymers such as polyvinyl acetate, polyacrylic ester and polyvinyl acetal, polyester resins such as polyethylene terephthalate and polybutylene terephthalate, polystyrene resin, polyamide resin, copolymer resins comprising an olefin, such as ethylene or propylene, and other vinyl monomer, ionomers, cellulosic resins such as cellulose diacetate and polycarbonate.

The thermal transfer image-receiving sheet according to the present invention can be produced by coating at least one surface of the above-described substrate sheet with a suitable organic solvent solution or water or organic solvent dispersion of the above described polycarbonate resin and optionally containing necessary additives, for example, a release agent, a crosslinking agent, a curing agent, a catalyst, a heat release agent, an ultraviolet absorber, an antioxidant and a photostabilizer, for example, by a gravure printing method, a screen printing method or a reverse roll coating method wherein use is made of a gravure print, and drying the resultant coating to form a dye-receiving layer.

In the formation of the receiving layer, it is possible to add pigments or fillers such as titanium oxide, zinc oxide, kaolin clay, calcium carbonate and finely divided silica for the purpose of further enhancing the sharpness of a transferred image through an improvement in the whiteness of the receiving layer.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

The image-receiving sheet of the present invention can be applied to various applications where thermal transfer recording can be conducted, such as cards and sheets for preparing transparent originals, by properly selecting the substrate sheet.

Further, in the image-receiving sheet of the present invention, a cushion layer may be optionally provided between the substrate sheet and the receiving layer, and the provision of the cushion layer enables an image less susceptible to noise during printing and corresponding to image information to be formed by transfer recording with good reproducibility. As a resin for the cushion layer, a polyurethane, a polybutadiene, a polyacryiate, a polyester, an epoxy resin, a polyamide, a rosin-modified phenol, a terpene phenol resin or an ethylene/vinylacetate copolymer or a mixture thereof can be employed.

The thermal transfer sheet for use in the case where thermal transfer is conducted through the use of the above-described thermal transfer sheet of the present invention comprises a paper or a polyester film and, provided thereon, a dye layer containing a heat migratable dye such as a sublimable dye, and any conventional thermal transfer sheet, as such, may be used in the present invention.

Means for applying thermal energy at the time of the thermal transfer may be any means known in the art. For example, a desired object can be sufficiently attained by applying a thermal energy of about 5 to 100 $mJ/mm^2$ through the control of a recording time by means of a recording device, for example, a thermal printer (for example, a video printer VY-100 manufactured by Hitachi, Limited).

The present invention will now be described in more detail with reference to the following Examples and Comparative Examples. In the Examples and Comparative Examples, "parts" or "%" is by weight unless otherwise specified.

REFERENCE EXAMPLE 1

Synthesis Example of polyoxyalkylene polyol 92 parts of glycerin as a starting compound was successively reacted with 220 parts of ethylene oxide and 108 parts of propylene oxide in the presence of 2 parts of potassium hydroxide as a catalyst, and desalination purification was conducted to provide 380 g of a polyoxyalkylene polyol (P-1) having a number average molecular weight of 400 (calculated from a hydroxyl value). Then, various polyoxyalkylene polyols listed in Table 1 were produced in the same manner as that described above.

TABLE 1

| | Polyoxyalkylene polyol | | | | | |
|---|---|---|---|---|---|---|
| | Active hydrogen compound | | Alkylene oxide (parts) | | | Number average molecular weight |
| | Kind | Parts | Ethylene oxide | Propylene oxide | Butyllene oxide | calculated from hydroxyl value |
| P-1 | glycerin | 92 | 220 | 108 | | 400 |
| P-2 | trimethylolpropane | 134 | 500 | | | 600 |
| P-3 | pentaerythritol | 136 | | | 150 | 260 |
| P-4 | dipentaerythritol | 254 | | 700 | | 910 |

TABLE 1-continued

| | Polyoxyalkylene polyol | | | | | |
|---|---|---|---|---|---|---|
| | Active hydrogen compound Kind | Parts | Alkylene oxide (parts) Ethylene oxide | Propylene oxide | Butylene oxide | Number average molecular weight calculated from hydroxyl value |
| P-5 | tris-(2-hydroxyethyl) isocyanulate | 261 | 280 | | | 510 |
| P-6 | hydrogenated bisphenol A | 224 | 1000 | 1000 | | 2000 |

EXAMPLES 1 TO 6

Synthetic paper (thickness: 100 μm; a product of Oji-Yuka Synthetic Paper Co., Ltd.) was used as the substrate sheet, and a coating solution having the following composition was coated and dried by means of a wire bar on one surface of the synthetic paper so that the coverage on a dry basis was 5.0 g/m$^2$, and the resultant coating was cured at 120° C. for 30 minutes to provide thermal transfer image-receiving sheets of the present invention.

| Composition of coating solution | |
|---|---|
| Polyoxyalkylene polyol listed in Table 1 | 15.0 parts |
| Catalytic curing silicone oil (X-62-1212 manufactured by The Shin-Etsu Chemical Co., Ltd.) | 1.5 parts |
| Platinum-based catalyst (Cat PL50T manufactured by The Shin-Etsu Chemical Co., Ltd.) | 0.1 part |
| Methyl ethyl ketone/toluene (weight ratio = 1/1) | 83.5 parts |
| Polyisocyanate (Coronate HK manufactured by Nippon Polyurethane Industry Co., Ltd.) | 30.0 parts |
| Dibutyl tin dilaurate (Isocyanate curing catalyst) | 0.1 part |

Separately, an ink composition for forming a dye-supporting layer was prepared according to the following formulation, coated by means of a wire bar on a 6 μm-thick polyethylene terephthalate film having a reverse face subjected to a treatment for rendering the face heat-resistant so that the coverage on a dry basis was 1.0 g/m$^2$, and the resultant coating was dried to provide a thermal transfer sheet.

| Ink composition | |
|---|---|
| Indoaniline dye represented by the following structural formula | 1.0 part |
| Polyvinyl butyral resin (S-lec BX-1 manufactured by Sekisui Chemical Co., Ltd.) | 10.0 parts |
| Methyl ethyl ketone/toluene (weight ratio = 1/1) | 90.0 parts |

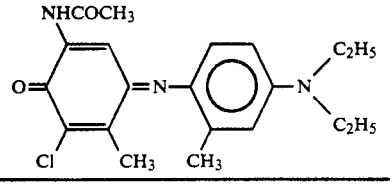

The above-described thermal transfer sheet and the above-described thermal transfer image-receiving sheet of the present invention were put on top of the other in such a manner that the dye layer and the dye receiving surface faced each other. Recording was conducted by means of a thermal head from the back surface of the thermal transfer sheet under conditions of a head applied voltage of 11.0 V, a pulse width of 16 msec and a dot density of 6 dots/line, and the results are given in the following Table 2. Various types of durability given in Table 2 were evaluated by the following methods.

(1) Light fastness test

The formed image was subjected to irradiation by means of a xenon fadeometer (Ci-35A manufactured by Atlas) at 100 KJ/m$^2$ (light dosage at 420 nm), the change in the optical density between before irradiation and after irradiation was measured by means of an optical densitometer (RD-918 manufactured by Mcbeth), and the retention of the optical density was determined according to the following equation. (standard density=1.0) Retention of dye image (%)={[optical density after irradiation]/[optical density before irradiation]}×100

◎:Retention was 90% or more.
○:Retention was 80% to 90% exclusive.
Δ:Retention was 70% to 80% exclusive.
X:Retention was less than 70%.

(2) Evaluation of fingerprint resistance

A finger was pressed against the surface of the print to leave a fingerprint, and the print was allowed to stand at room temperature for 5 days. Then, the discoloration and change in the density of the fingerprinted portion was evaluated with the naked eye.

A: Substantially no difference was observed between the fingerprinted portion and the non-fingerprinted portion.
B: A discoloration or a change in the density was observed.
C: Dropout occurred in the fingerprinted portion to such an extent that the shape of the fingerprint was clearly observed.
D: Dropout centered on the fingerprinted portion occurred and, at the same time, agglomeration of the dye was observed.

(3) Evaluation of plasticizer resistance

An identical portion of the surface of the print was lightly rubbed with a commercially available eraser 5 times, and the change in the density was evaluated with the naked eye.

A: Substantially no change in the density was observed.
B: Change in the density was observed.

C: The density was greatly changed, and dropout occurred from the low density portion to the medium density portion.

COMPARATIVE EXAMPLE 1

The procedure of Example 1 was repeated to form a comparative thermal transfer image-receiving sheet, except that, in the composition of the coating solution of Example 1, polyoxyalkylene polyol and polyisocyanate and their proportions were changed as follows.

| | |
|---|---|
| Vinyl chloride/vinyl acetate/ vinyl alcohol copolymer (VAGH manufactured by Union Carbide Corp.) | 15 parts |
| Polyisocyanate (Coronate HK manufactured by Nippon Polyurethane Industry Co., Ltd.) | 6 parts |
| Dibutyl tin dilaurate (isocyanate curing catalyst) | 0.1 part |

COMPARATIVE EXAMPLE 2

The procedure of Comparative Example 1 was repeated to form a comparative thermal transfer image-receiving sheet, except that polyisocyanate was omitted from the composition used in Comparative Example 1.

COMPARATIVE EXAMPLE 3

The procedure of the above Examples was repeated to form a comparative thermal transfer image-receiving sheet, except that, in the composition of the coating solution of the above Examples, polyoxyalkylene polyol and polyisocyanate and their proportions were changed as follows.

| | |
|---|---|
| Polyester resin (Vylon GK-130 manufactured by Toyobo Co., Ltd.) | 15 parts |
| Polyisocyanate (Coronate HK manufactured by Nippon Polyurethane Industry Co., Ltd.) | 11 parts |

TABLE 2

| | Light fastness | Fingerprint resistance | Plasticizer resistance | Overall evaluation |
|---|---|---|---|---|
| Ex. 1 | ◎ | A | A | ○ |
| Ex. 2 | ◎ | A | A | ○ |
| Ex. 3 | ◎ | A | A | ○ |
| Ex. 4 | ◎ | A | A | ○ |
| Ex. 5 | ○ | A | A | ○ |
| Ex. 6 | ○ | A | A | ○ |
| Comp. Ex. 1 | ○ | B | B | X |
| Comp. Ex. 2 | ○ | C | C | X |
| Comp. Ex. 3 | Δ | B | B | X |

As described above, according to the present invention, when a product of a reaction of a polyoxyalkylene polyol with an organic polyisocyanate resin is used as a resin component for the formation of a dye-receiving layer, it becomes possible to provide a thermal transfer image-receiving sheet which can form a sharp image having a sufficient density and excellent in various types of fastness, particularly durability such as light fastness, fingerprint resistance and plasticizer resistance.

We claim:

1. A thermal transfer image-receiving sheet comprising a substrate sheet and a dye-receiving layer formed on at least one surface of the substrate sheet, wherein said dye-receiving layer comprises a product of a reaction of a polyoxyalkylene polyol with an organic polyisocyanate.

2. A thermal transfer image-receiving sheet according to claim 1, wherein the polyoxyalkylene polyol has a number average molecular weight of 200 to 10,000 and is produced by addition-polymerizing a compound having two or more active hydrogen atoms with an alkylene oxide having 2 to 4 carbon atoms.

3. A thermal transfer image-receiving sheet according to claim 1, wherein the polyoxyalkylene polyol has a number average molecular weight of 200 to 5,000 and comprises at least one member selected from the group consisting of compounds represented by the following structural formulae A to E:

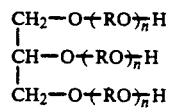
(A)

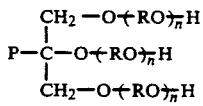
(B)

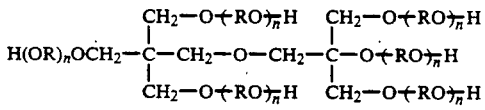
(C)

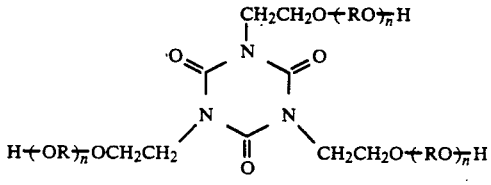
(D)

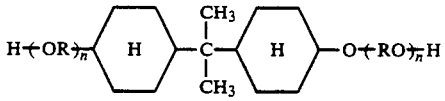
(E)

wherein R stands for $-C_2H_4-$,

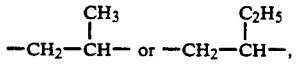

P stands for $CH_2CH_3$ or $CH_2O-(-RO-)_n-H$ and n is a numeric value capable of providing a number average molecular weight of 200 to 5,000.

4. A thermal transfer image-receiving sheet according to claim 1, wherein the dye-receiving layer contains a reactive release agent.

5. A heat transfer assemblage comprising:

a thermal transfer sheet comprising a dye layer; and a thermal transfer image-receiving sheet comprising a substrate sheet, and a dye-receiving layer formed on at least one surface of said substrate sheet, said dye-receiving layer comprising a product of a reaction of a polyoxyalkylene polyol with an organic polyisocyanate.

* * * * *